US007295197B2

(12) United States Patent
Abe et al.

(10) Patent No.: US 7,295,197 B2
(45) Date of Patent: Nov. 13, 2007

(54) FLAT-PANEL DISPLAY APPARATUS AND ITS CONTROL METHOD

(75) Inventors: Naoto Abe, Kanagawa-ken (JP); Tatsuro Yamazaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 10/775,168

(22) Filed: Feb. 11, 2004

(65) Prior Publication Data

US 2004/0155875 A1 Aug. 12, 2004

Related U.S. Application Data

(63) Continuation of application No. 09/534,445, filed on Mar. 24, 2000, now Pat. No. 6,738,055.

(30) Foreign Application Priority Data

Mar. 24, 1999 (JP) ..... 11-080462

(51) Int. Cl.
*G09G 5/00* (2006.01)

(52) U.S. Cl. ..... 345/211; 713/310; 713/320

(58) Field of Classification Search ..... 345/211, 345/212, 213; 713/310, 320, 322, 323, 324
See application file for complete search history.

(56) References Cited

U.S. PATENT DOCUMENTS

| | | | | |
|---|---|---|---|---|
| 5,481,299 | A | 1/1996 | Coffey et al. | 348/173 |
| 5,525,867 | A | 6/1996 | Williams | 315/169.3 |
| 5,598,565 | A | 1/1997 | Reinhardt | 395/750 |
| 5,757,365 | A * | 5/1998 | Ho | 345/212 |
| 5,765,001 | A | 6/1998 | Clark et al. | 395/750.08 |
| 5,867,140 | A | 2/1999 | Rader | 345/98 |
| 6,005,559 | A | 12/1999 | Miyamoto | 345/212 |
| 6,091,203 | A | 7/2000 | Kawashima et al. | 345/211 |
| 6,184,875 | B1 | 2/2001 | Matsuura | 345/211 |
| 6,249,270 | B1 | 6/2001 | Ito | 345/211 |
| 6,331,844 | B1 * | 12/2001 | Okumura et al. | 345/87 |
| 6,523,127 | B1 * | 2/2003 | Takasu | 713/324 |
| RE38,108 | E * | 5/2003 | Chee et al. | 345/212 |

(Continued)

FOREIGN PATENT DOCUMENTS

JP 4-115288 4/1992

(Continued)

OTHER PUBLICATIONS

Japanese Office Action dated May 13, 2005, issued in corresponding Japanese patent application No. 11-080462.

*Primary Examiner*—Amr A. Awad
*Assistant Examiner*—Tom V Sheng
(74) *Attorney, Agent, or Firm*—Fitzpatrick, Cella, Harper & Scinto

(57) ABSTRACT

A display apparatus includes a display panel having a plurality of display elements, and a display controller for controlling the display panel in a normal display mode, a first power saving mode, a second power saving mode and a third power saving mode. A mode transition device causes the display panel to shift to the first power saving mode or the third power saving mode from a normal mode based on an instruction of a user, and causes the display panel to shift to the second power saving mode from the normal mode based on status of the display panel.

14 Claims, 11 Drawing Sheets

U.S. PATENT DOCUMENTS 6,801,196 B1 * 10/2004 Bodley et al. ..... 345/211
6,934,772 B2 * 8/2005 Bui et al. ..... 710/14

FOREIGN PATENT DOCUMENTS

JP 7-5861 1/1995
JP 9-90317 4/1997
JP 10-39962 2/1998
JP 11-3063 1/1999
JP 11-65531 3/1999

* cited by examiner

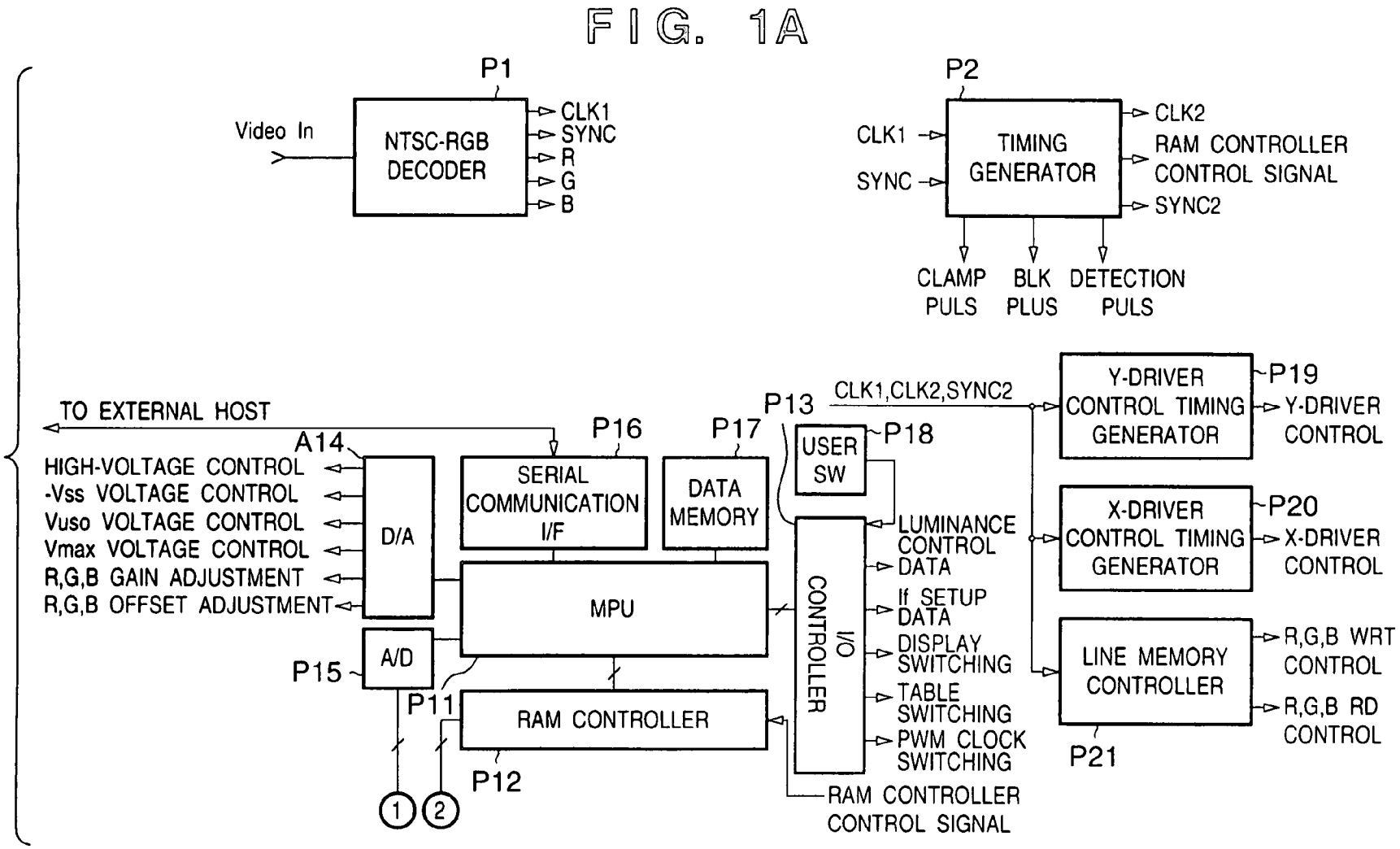
FIG. 1A
P1
NTSC-RGB DECODER
CLK1
SYNC
R
G
B
Video In
P2
TIMING GENERATOR
CLK1
SYNC
CLK2
RAM CONTROLLER CONTROL SIGNAL
SYNC2
CLAMP PULS
BLK PLUS
DETECTION PULS
P19
Y-DRIVER CONTROL TIMING GENERATOR
Y-DRIVER CONTROL
P20
X-DRIVER CONTROL TIMING GENERATOR
X-DRIVER CONTROL
LINE MEMORY CONTROLLER
P21
R,G,B WRT CONTROL
R,G,B RD CONTROL
CLK1,CLK2,SYNC2
P13
P18
USER SW
I/O CONTROLLER
LUMINANCE CONTROL DATA
If SETUP DATA
DISPLAY SWITCHING
TABLE SWITCHING
PWM CLOCK SWITCHING
RAM CONTROLLER CONTROL SIGNAL
P17
DATA MEMORY
P16
SERIAL COMMUNICATION I/F
MPU
RAM CONTROLLER
P12
P11
D/A
A/D
A14
P15
TO EXTERNAL HOST
HIGH-VOLTAGE CONTROL
-Vss VOLTAGE CONTROL
Vuso VOLTAGE CONTROL
Vmax VOLTAGE CONTROL
R,G,B GAIN ADJUSTMENT
R,G,B OFFSET ADJUSTMENT

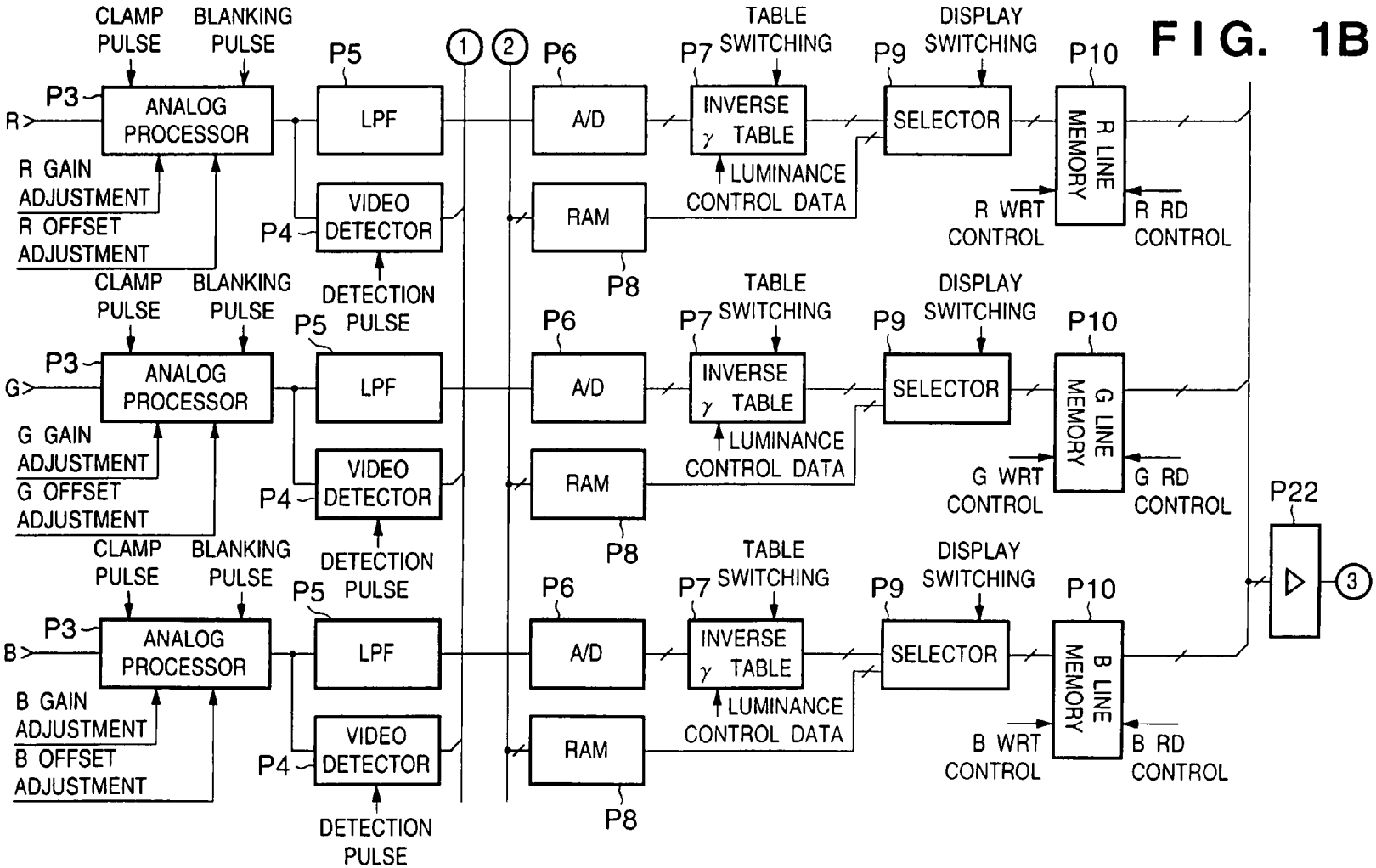
FIG. 1B
R
G
B
CLAMP PULSE
BLANKING PULSE
P3
ANALOG PROCESSOR
R GAIN ADJUSTMENT
R OFFSET ADJUSTMENT
G GAIN ADJUSTMENT
G OFFSET ADJUSTMENT
B GAIN ADJUSTMENT
B OFFSET ADJUSTMENT
P4
VIDEO DETECTOR
DETECTION PULSE
P5
LPF
1
2
P6
A/D
P7
TABLE SWITCHING
INVERSE γ TABLE
LUMINANCE CONTROL DATA
P8
RAM
P9
DISPLAY SWITCHING
SELECTOR
P10
R LINE MEMORY
G LINE MEMORY
B LINE MEMORY
R WRT CONTROL
R RD CONTROL
G WRT CONTROL
G RD CONTROL
B WRT CONTROL
B RD CONTROL
P22
3

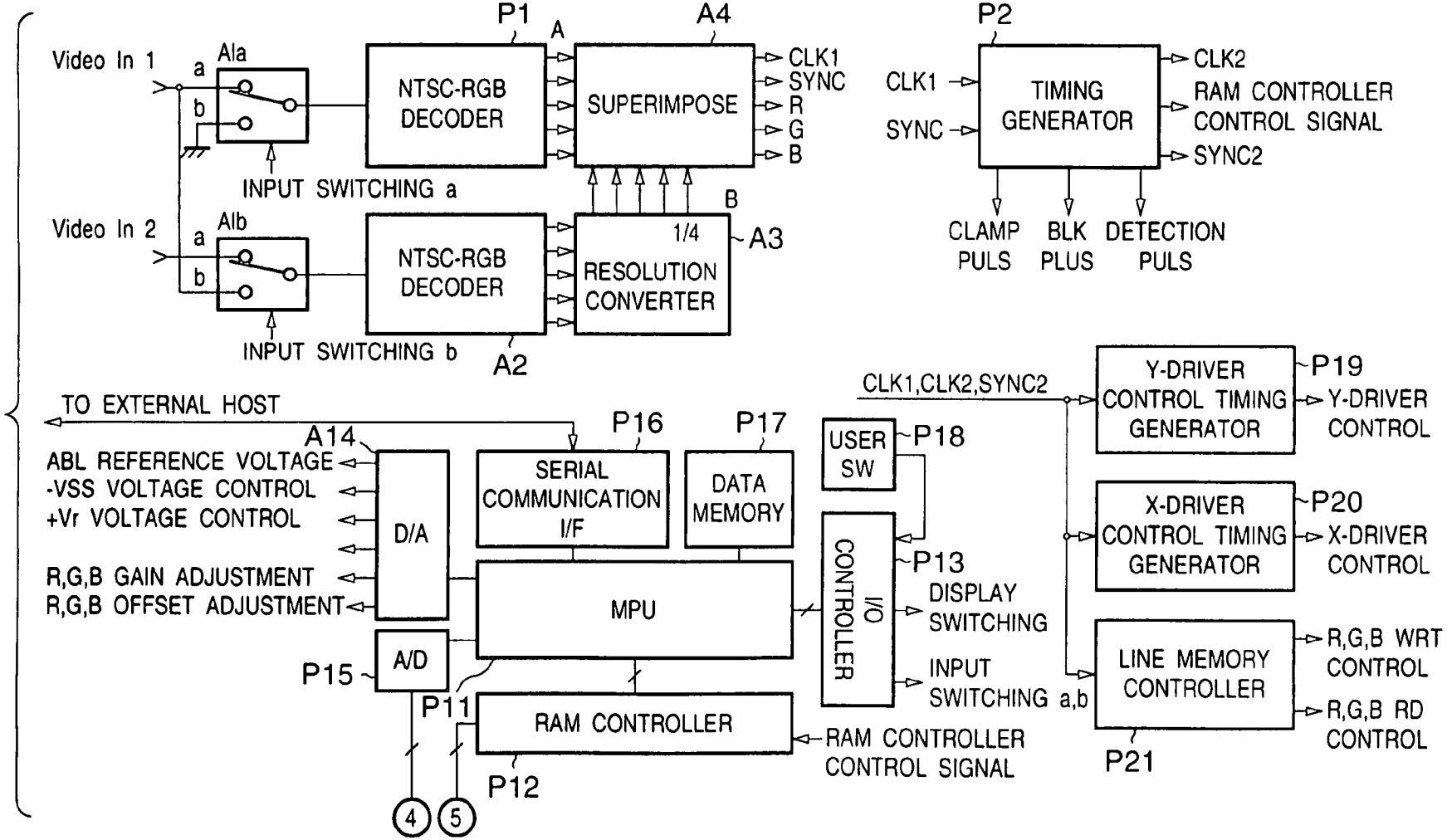
FIG. 5A
P2
TIMING GENERATOR
CLK1
SYNC
CLK2
RAM CONTROLLER CONTROL SIGNAL
SYNC2
CLAMP PULS
BLK PLUS
DETECTION PULS
P19
Y-DRIVER CONTROL TIMING GENERATOR
Y-DRIVER CONTROL
P20
X-DRIVER CONTROL TIMING GENERATOR
X-DRIVER CONTROL
LINE MEMORY CONTROLLER
P21
R,G,B WRT CONTROL
R,G,B RD CONTROL
CLK1,CLK2,SYNC2
a,b
P18
USER SW
P13
I/O CONTROLLER
DISPLAY SWITCHING
INPUT SWITCHING
RAM CONTROLLER CONTROL SIGNAL
A4
SUPERIMPOSE
CLK1
SYNC
R
G
B
A3
1/4 RESOLUTION CONVERTER
A
B
P1
NTSC-RGB DECODER
A2
NTSC-RGB DECODER
INPUT SWITCHING a
INPUT SWITCHING b
A1a
A1b
a
b
Video In 1
Video In 2
P17
DATA MEMORY
P16
SERIAL COMMUNICATION I/F
MPU
RAM CONTROLLER
P12
P11
D/A
A/D
P15
A14
TO EXTERNAL HOST
ABL REFERENCE VOLTAGE
-VSS VOLTAGE CONTROL
+Vr VOLTAGE CONTROL
R,G,B GAIN ADJUSTMENT
R,G,B OFFSET ADJUSTMENT
4
5

T101 DECODED COMPONENT VIDEO SIGNAL
T102 SYNC SIGNAL
T103 CLK
T104 COLOR SAMPLE DATA
T105 LUMINANCE DATA
T106
T107 SFTCLK
T108 LD
T109
T110 PWMGEN OUTPUT
T111 OUTPUT VOLTAGE WAVEFORM OF GIVEN COLUMN
T112 1ST LINE OUTPUT
2ND LINE OUTPUT
3RD LINE OUTPUT
240TH LINE OUTPUT
HI LEVEL
GND
+Vf
GND -Vss
2ND LINE
3RD LINE
4TH LINE
m-TH LINE
1ST LINE
2ND LINE
3RD LINE
240TH LINE
1
2
12
240
720

FLAT-PANEL DISPLAY APPARATUS AND ITS CONTROL METHOD

This is a continuation application of application Ser. No. 09/534,445, filed on Mar. 24, 2000 now U.S. Pat. No. 6,738,055.

FIELD OF THE INVENTION

The present invention relates to an image display apparatus control system and image display system control method, which can display input image information on an image display apparatus via an interface with a simple arrangement.

BACKGROUND OF THE INVENTION

In a conventional computer system, a CRT display apparatus is used as a standard monitor display. Due to the large consumption of power by a CRT display, the computer system, e.g., enters a power saving mode and de-energizes a CRT of the monitor display apparatus (which consumes most of the electric power) when there has been no operation input for a predetermined period of time, thus setting a standby state.

However, the operation control of the power saving mode is limited to a CRT display apparatus, but is not done for other types of display apparatuses. Even apparatuses other than the CRT require power savings. Furthermore, as for a normal television broadcast display, the user may leave home or fall asleep without turning off its power switch, and if the display can enter the power saving mode in such case, it is very convenient for the user.

SUMMARY OF THE INVENTION

The present invention has been made to solve the aforementioned problems and has as its object to provide a flat-panel display apparatus having, e.g., a power saving operation mode.

It is another object of the present invention to provide a flat-panel display apparatus that can control the selection of one of a power saving mode that suffers less deterioration of image quality and a power saving mode that suffers some deterioration of image quality. This flat-panel display apparatus can implement a power saving mode that, when automatically set, displays an image similar to an image displayed in a normal display mode and does not require the operator to select the power saving mode that suffers less image quality deterioration. Also, this display apparatus can select either power saving mode when the power saving mode is set by user's operation. This display apparatus can be applied to a television broadcast display apparatus and the like, in addition to a display control of a computer terminal.

It is still another object of the present invention to provide a flat-panel display apparatus which allows the user to recognize the broadcast state and power saving mode control without any serious troubles, and can immediately recover a normal operation mode as needed, even in such case.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 1A to 1C are schematic block diagrams of a display apparatus using a display panel (SED panel) according to the first embodiment of the present invention;

FIGS. 5A to 5C are schematic block diagrams of a display apparatus using a display panel (SED panel) according to the second embodiment of the present invention;

DETAILED DESCRIPTION OF THE PREFERRED EMBODIMENTS

The preferred embodiments of the present invention will be described in detail hereinafter with reference to the accompanying drawings. The following explanation will be given taking as an example a case wherein a Surface Conduction Electron Emitter Display (to be abbreviated as SED hereinafter) as a wall-mounted flat-panel display is used as a display apparatus.

First Embodiment

An example of power saving control that controls a display apparatus using an SED panel as a display panel by current-driven PWM will be explained below.

(Arrangement of Display Apparatus)

Figure 1C:
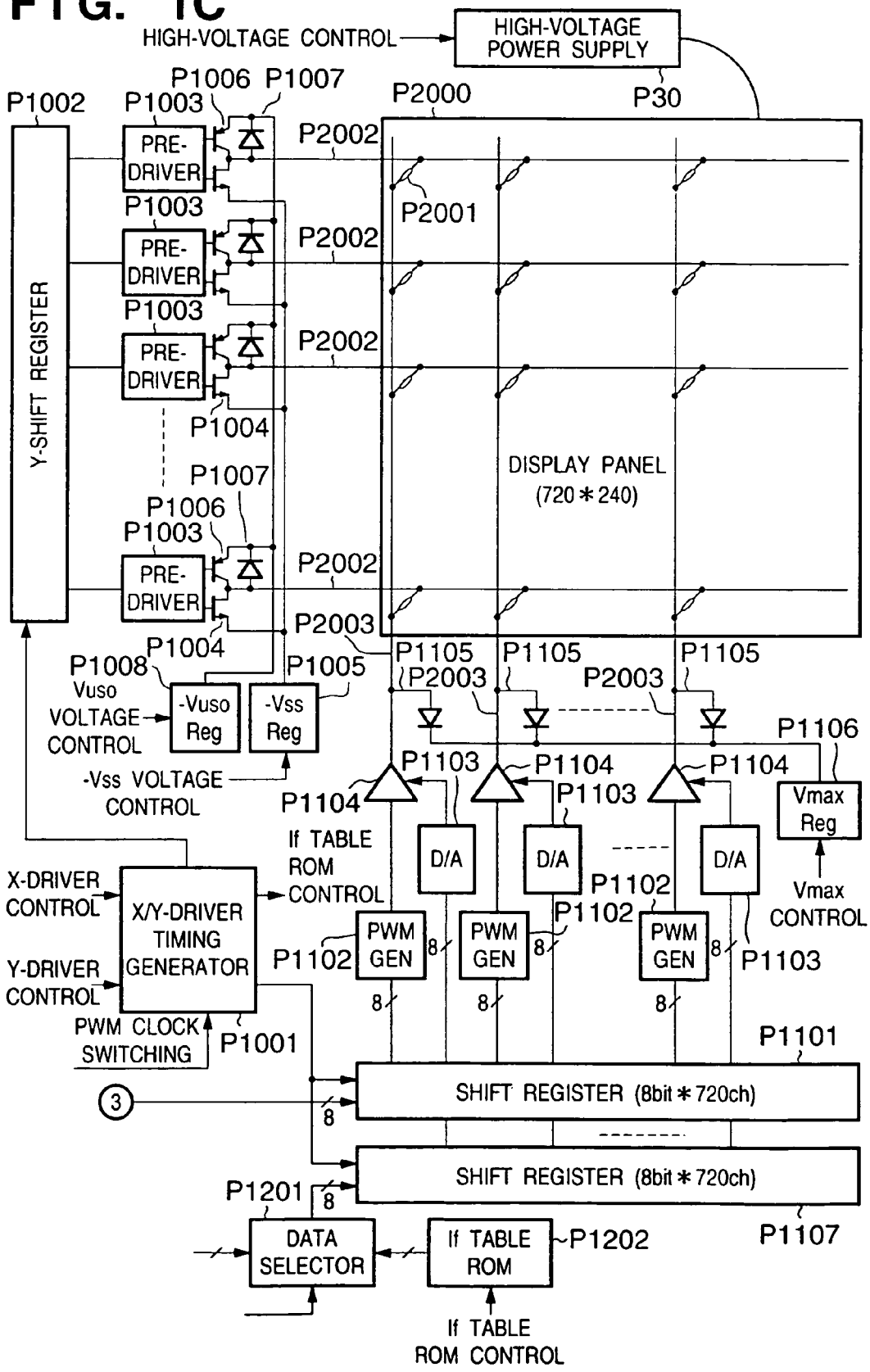
Figure 2:
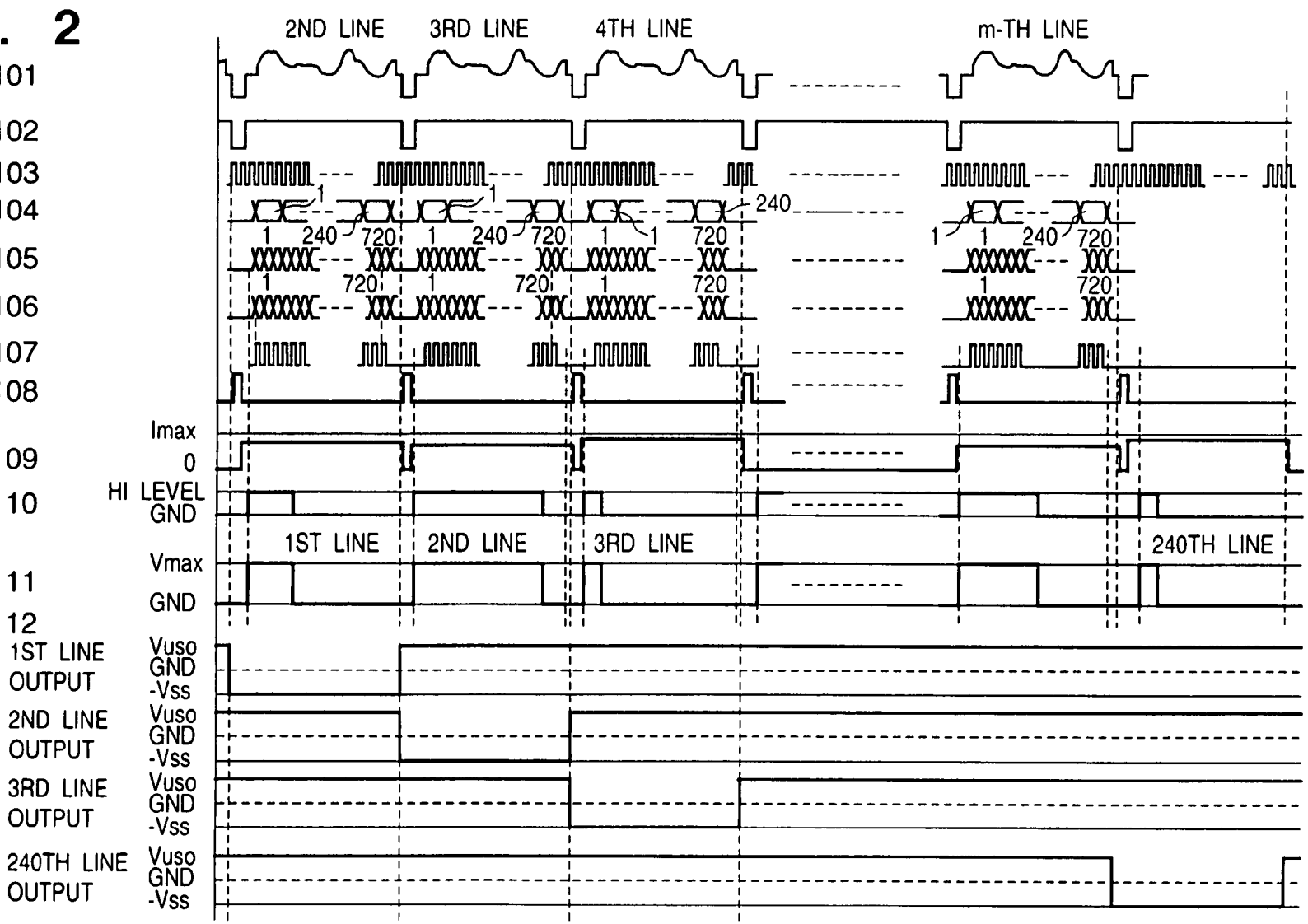
FIG. 2 is a timing chart showing the operation of the first embodiment shown in FIGS. 1A to 1C.

FIGS. 1A to 1C are schematic block diagrams of a display apparatus using a display panel (SED panel) according to one embodiment of the present invention, and mainly show the arrangement of a driving circuit section in detail. FIG. 2 is a timing chart of the operation of the embodiment shown in FIGS. 1A to 1C.

Referring to FIG. 2, T101 represents an example of a decoded component video signal (to be described later); T102, a sync signal; T103, a clock signal CLK; T104, color sample data; T105, luminance data; T107, a clock signal SFTCLK; T108, an LD pulse signal; T110, a PWMGEN signal output; T111, an example of an output voltage waveform of a given column; and T112, an output example of the first to 240th rows.

Referring to FIGS. 1A to 1C, reference numeral P2000 denotes a display panel. In this embodiment, 240×720 surface conduction elements P2001 are connected in a matrix by 240 (counted in the vertical direction) row interconnects (scan interconnects) and 720 (counted in the horizontal direction) column interconnects (modulation interconnects), and electron beams emitted by the individual surface conduction elements P2001 are accelerated by a high voltage applied by a high voltage power supply P30 and impinge on phosphors (not shown), thus emitting light. The phosphors (not shown) can have various color matrix structures in accordance with applications. For example, in this embodiment, an RGB vertical stripe-like matrix structure can be used.

In this embodiment, a case will be exemplified below wherein a television image of NTSC or equivalent format is displayed on the display panel P2000 having 240 (RGB trios; horizontal)×240 (lines; vertical) pixels. However, the present invention is not limited to such specific example, and can easily cope with image signals having different resolutions and frame rates such as a high-definition image of, e.g., HDTV, computer output image, and the like in addition to NTSC using substantially the same arrangement.

Reference numeral P1 denotes an NTSC-RGB decoder for receiving a composite video signal in the NTSC format and outputting R, G, and B components. The NTSC-RGB decoder P1 separates and outputs a sync signal (SYNC) superposed on the input composite video signal in the NTSC format. Also, the decoder P1 separates a color burst signal superposed on the input video signal, and generates and outputs a CLK signal (CLK1) synchronous with the color burst signal.

Reference numeral P2 denotes a timing generator for generating the following timing signals required for converting analog R, G, and B signals decoded by the NTSC-RGB decoder P1 into digital grayscale signals used to luminance-modulate the display panel (SED panel) P2000:

- clamp pulses used when analog processors P3 DC-restore analog R, G, and B signals from the NTSC-decoder P1;
- blanking pulses (BLK pulse) used to add a blanking period to analog R, G, and B signals from the NTSC-RGB decoder in the analog processor P3;
- detection pulses used to detect the levels of the analog R, G, and B signals by video detectors P4 equipped in units of colors;
- sample pulses (not shown) used to convert the analog R, G, and B signals into digital signals by A/D units 6 equipped in units of colors;
- a RAM controller control signal required for a RAM controller P12 to control image memories P8 equipped in units of colors;
- a free-running CLK signal (CLK2) which is generated in the timing generator P2 and is synchronized with CLK1 via a PLL circuit in the timing generator P2 upon input of CLK1; and
- a sync signal (SYNC2) generated in the timing generator P2 based on CLK2.

Since the timing generator P2 comprises a free-running CLK2 generation means, it can generate CLK2 and SYNC2 as reference signals even when no input video signal is available. For this reason, an image can be displayed by reading out image data stored in the image memories P8 equipped in units of colors.

Reference numeral P3 denotes analog processors which are equipped in correspondence with primary color signals output from the NTSC-RGB decoder P1, and mainly perform:

- DC restoration upon receiving clamp pulses from the timing generator P2;
- addition of a blanking period upon receiving BLK pulses from the timing generator P2;
- amplitude control of primary color signals input from the NTSC-RGB decoder P1 upon receiving a gain adjustment signal from a D/A unit P14 as one of the control outputs from a system controller including an MPU P11 as a main unit; and
- black-level control of primary color signals input from the NTSC-RGB decoder P1 upon receiving an offset adjustment signal from the D/A unit P14 as one of the control outputs from the system controller including the MPU P11 as a main unit.

Reference numeral P4 denotes video detectors which are equipped in units of colors and detect video signal levels which have been controlled by the analog controllers P3. The detection results of these detectors are read by an A/D unit 15 as one of the control inputs to the system controller including the MPU P11 as a main unit in response to the detection pulses from the timing generator P2.

The detection pulses from the timing generator P2 include three types of pulses, e.g., a gate pulse, reset pulse, and sample & hold (S/H) pulse. Each of the video detectors P4 equipped in units of colors can be constructed by, e.g., an integrating circuit and S/H circuit.

For example, the integrating circuit integrates an input video signal during the effective period of the input video signal in response to the gate pulse, and the S/H circuit samples the output from the integrating circuit in response to the S/H pulse generated during the vertical blanking period. After an A/D unit P15 reads the detection result during the vertical blanking period, the integrating circuit and S/H circuit are reset by the reset pulse.

With this operation, the average video level in units of fields can be detected.

LPFs P5 equipped in units of colors are pre-filter means inserted before A/D units P6 equipped in units of colors. The A/D units P6 equipped in units of colors are A/D converter means which quantize analog primary color signals filtered by the LPFs P5 equipped in units of colors by the required number of gray levels upon receiving sample clocks CLK from the timing generator P2.

Inverse γ (inverse gamma) tables P7 are tone characteristic conversion means adapted to convert the input video signal into emission characteristics of the display panel. When the luminance gradient is expressed by pulse-width modulation like in this embodiment, linear characteristics in which the amount of emitted light is nearly proportional to the magnitude of luminance data are often exhibited.

On the other hand, a video signal has undergone a γ process to correct nonlinear emission characteristics of a CRT assuming a TV receiver using a CRT as an application. When an image for television broadcast (television image) is to be displayed on a display panel having linear emission characteristics like in this embodiment, the γ process effect must be canceled using the tone characteristic conversion means such as the inverse γ tables P7.

Data of these tables P7 can be switched by the output from an I/O controller P13 as one of the control inputs/outputs of the system controller including the MPU P11 as a main unit, thus changing emission characteristics to desired ones.

Reference numeral P8 denotes image memories (RAMs) provided in correspondence with R, G, and B processing circuits. Each image memory P8 has addresses corresponding to the total number of display pixels of the panel (in case of the display panel shown in FIG. 1C, it has 240 (horizontal)×240 lines (vertical)×3 addresses). These image memories P8 store luminance data to be emitted by the individual pixels of the panel, and the luminance data are read out pixel-sequentially, thereby displaying image data stored in the image memories P8 on the display panel P2000.

The luminance data are output from the image memories P8 under the address control of the RAM controller P12.

Data are written in the image memories P8 under the control of the system controller including the MPU P11 as a main unit. In case of a simple test pattern or the like, the MPU P11 may directly compute luminance data to be stored at the individual addresses of the image memories P8 and may write them in the memories. On the other hand, in case of a pattern such as a natural still image, an image file stored in, e.g., an external computer is loaded via a serial communication I/F P16 as one of I/O units of the system controller including the MPU P11 as a main unit, and is written in the image memories P8.

Reference numeral P9 denotes data selectors equipped in units of colors. The data selectors P9 determine in accordance with the output from the I/O controller P13 as one of the control inputs/outputs of the system controller including the MPU P11 as a main unit whether image data to be output in units of colors are data from the image memories P8 or those from the A/D units P6 (input video signal systems) and inverse γ tables P7.

The data selectors P9 also have a mode of generating fixed values from the output selectors P9 in addition to input select modes of these two systems, and when this mode is selected by the I/O controller P13, fixed values can be output from the output selectors P9. With this mode, an adjustment signal such as a pattern of all white pixels can be displayed at high speed without any external inputs.

Reference numeral P10 denotes horizontal one-line memory means equipped in units of primary color signals. These line memory means rearrange parallel luminance data input from the three, i.e., R, G, and B systems in the order corresponding to the panel color matrix structure of the panel in response to a control signal from a line memory controller P21 to convert them into a serial signal for one system, and output the converted signal to an X-driver (to be described later) via a latch means P22.

The system controller mainly comprises the MPU P11, the serial communication I/F P16, the I/O controller P13, the D/A unit P14, the A/D unit P15, a data memory P17, and a user switch (SW) unit P18.

The system controller receives a user request input from the user SW unit P18 or serial communication I/F P16, and outputs a corresponding control signal from the I/O controller P13 or D/A unit P14 to execute that request.

The system controller receives a system monitoring signal from the A/D unit P15, and outputs a corresponding control signal from the I/O controller P13 or D/A unit P14, thus executing optimal automatic control.

As the user request of this embodiment, display control such as generation of a test pattern, variations of tone characteristics, brightness/color control, and the like can be implemented. As described above, by monitoring the average video levels from the video detectors P4 by the A/D unit P15, automatic control such as ABL or the like can be done.

Also, the data memory P17 can save the user adjustment amounts.

Reference numeral P19 denotes a Y-driver control timing generator; and P20, an X-driver control timing generator. These generators P19 and P20 respectively generate Y- and X-driver control signal upon receiving signals CLK1, CLK2, and SYNC2.

Reference numeral P21 denotes a controller for controlling the timings of the line memories P10. The controller P21 generates R_WRT, G_WRT, and B_WRT control signals for writing luminance data in the line memories P10, and R_RD, G_RD, and B_RD control signals for reading out luminance data in the order corresponding to the panel color matrix structure from the line memories P10 upon receiving the signals CLK1, CLK2, and SYNC2.

In FIG. 2, T104 represents an example of the waveform of a color sample data sequence of one of R, G, and B colors, which consists of 240 data during one horizontal period. The data sequence is written in the corresponding line memory P10 in response to the control signal. During the next horizontal period, the line memory P10 for each color is read-enabled at a frequency three times the write frequency, thus obtaining 720 luminance data per horizontal period, as indicated by T105.

Reference numeral P1001 denotes an X/Y-driver timing generator, which receives the control signals from the Y- and X-driver control timing generators P19 and P20, and outputs the following signals for X-driver control:

shift clocks;

LD pulses which are used to fetch data loaded into shift registers P1101 and P1107 into memory means (not shown) in PWM generators P1102 and D/A units P1103 provided in units of columns, and which serve as triggers of the horizontal periods for the PWM generators P1102 and D/A units P1103; and an If table ROM control signal as a control signal of an If table ROM P1202.

Also, the generator P1001 outputs horizontal period shift clocks for driving a Y-shift register P1002 for Y-driver control, and a vertical period trigger signal that gives a row scan start trigger.

The shift register P1101 reads a luminance data sequence for the 720 column interconnects in units of horizontal periods from the latch P22 in response to shift clocks (SFTCLK) which are generated by the X/Y-driver timing generator P1101 and are synchronous with luminance data indicated by T107 in FIG. 2, and simultaneously transfers 720 data for one horizontal row to the PWM generators P1102 in response to LD pulses indicated by T108.

The shift register P1107 reads a column interconnect drive current data sequence for the 720 column interconnects in units of horizontal periods from a data selector means P1201 in response to the shift clocks in the same manner as the luminance data, and simultaneously transfers 720 data for one horizontal row to the D/A units P1103 in response to the LD pulses indicated by P108.

The If table ROM P1202 is a memory means for storing current amplitude value data to be supplied to the 720×240 surface conduction elements of the display panel P2000. The ROM P1202 outputs 720 current amplitude value data for one row to be scanned in units of horizontal periods (T105 in FIG. 2) under the read address control based on the If table ROM control signal output from the X/Y-driver timing generator P1001.

In this embodiment, since current values for driving the column interconnects (i.e., surface conduction elements) are set at optimal values in units of elements using the If table ROM P1202, luminance uniformity improves very much.

The data selector means P1201 is equipped for a case wherein no If table ROM P1202 is used for the purpose of, e.g., a cost reduction. In such case, If setup data output from the I/O controller P13 as one of the control inputs/outputs of the system controller including the MPU P11 as a main unit can be output to the shift register P1107 in response to a switching signal from the I/O controller P13.

The PWM generators P1102 provided in units of column interconnects receive luminance data from the shift register P1101, and generate pulse signals (PWMGEN) each having a pulse width proportional to the magnitude of data in units of horizontal periods, as indicated by the waveform T110 in FIG. 2.

The D/A units P1103 equipped in units of column interconnects are current-output digital-to-analog converters, which receive current amplitude value data from the shift register P1107, and generate drive currents each having a current amplitude proportional to the magnitude of data in units of horizontal periods, indicated by the waveform T111 in FIG. 2.

Reference numeral P1104 denotes switch means comprising transistors and the like. The switch means P1104 apply the current outputs from the D/A units P1103 to the column interconnects during an output enable period of the PWM generators P1102, and connects the column interconnects to ground during an output disable period of the PWM generators P1102. T111 in FIG. 2 represents an example of the output voltage waveform (column interconnect drive waveform) of a given column.

The common terminals of diode means P1105 provided in units of column interconnects are connected to a Vmax regulator P1106. The Vmax regulator P1106 is a constant voltage source capable of current sink, and forms a protection circuit for protecting the 720×240 surface conduction elements of the display panel P2000 from being applied with excessive voltages in collaboration with the diode means P1105.

This protection voltage (a potential defined by Vmax and −Vss applied upon selecting a row interconnect to be scanned) is supplied from the D/A unit P14 as one of the control inputs/outputs of the system controller including the MPU P11 as a main unit.

The diode means P1105 can change the Vmax potential (or −Vss potential) for the purpose of luminance control in addition to excessive voltage protection of the surface conduction elements.

The Y-shift register P1002 receives horizontal period shift clocks and a vertical period trigger signal for giving a row scan start trigger from the X/Y-driver timing generator P1001, and outputs in turn select signals for scanning the row interconnects to pre-drivers P1003 provided in units of row interconnects.

An output unit for driving each row interconnect comprises, e.g., a transistor P1006, FET P1004, and diode P1007. Each pre-driver P1003 drives this output unit in short response time.

Each FET P1004 is a switch means which is enabled when the corresponding row is selected. When the corresponding row is selected, the FET P1004 applies a −Vss potential from a constant voltage regulator P1005 to the corresponding row interconnect. Each transistor P1006 is a switch means which is enabled when the corresponding row is not selected. When the corresponding row is not selected, the transistor P1006 applies a Vuso potential from a constant voltage regulator P1008 to the corresponding row interconnect. T112 in FIG. 2 represents an example of the row interconnect drive waveform. Each diode P1007 is equipped to prevent an abnormal potential from being generated on the corresponding row interconnect, and to protect the output unit for driving the corresponding row interconnect.

The constant voltage regulators P1005 and P1008 for respectively generating the −Vss and Vuso potentials are controlled by the D/A unit P14 as one of the control inputs/outputs of the system controller including the MPU P11 as a main unit.

Also, the high voltage power supply P30 is controlled by the D/A unit P14 as one of the control inputs/outputs of the system controller including the MPU P11 as a main unit.

(Description of Power Saving Function)

In this embodiment with the aforementioned arrangement shown in FIGS. 1A to 1C, a special power saving mode to be described below is not executed in normal display control. However, when no instruction operation has been made for a predetermined period of time, when an infrared detection function is equipped in a room to be able to detect motion of a person around the display apparatus and no motion of the person has been detected for a predetermined period of time, when display data is a television broadcast or video playback image and white noise has been displayed for a predetermined period of time, or when a display signal has not changed for a predetermined period of time, the control for starting the power saving mode to be described below can be made.

In this manner, electric power that has been customarily consumed by the conventional display apparatus in an unnecessary situation can be minimized. Note that the transition control to the power saving mode is not limited to the aforementioned automatic control, but the power saving mode may be started when the operator operates a television remote controller or control panel.

Figure 3:
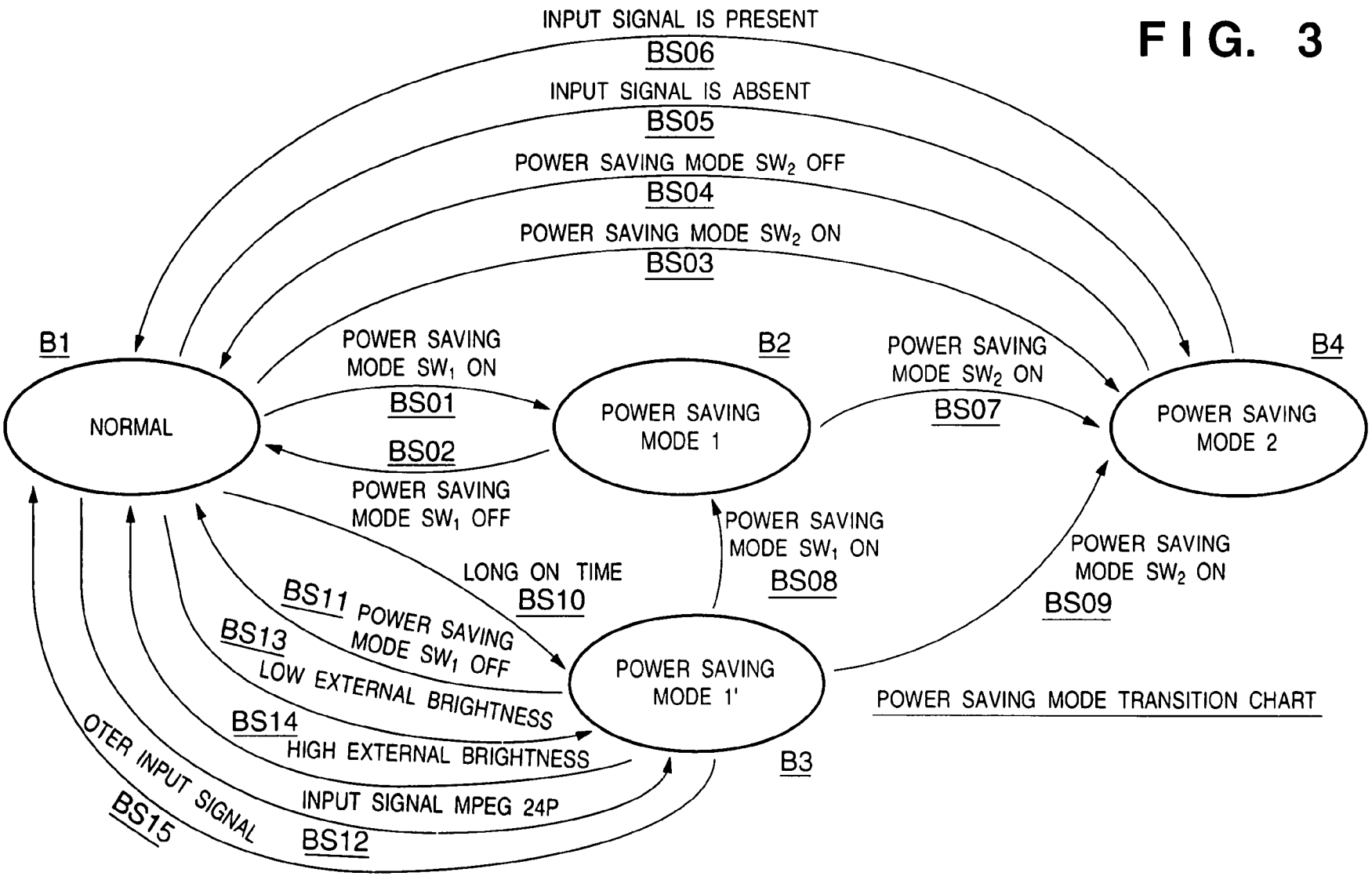
FIG. 3 is a chart showing an example of transition control to power saving modes in the display apparatus shown in FIGS. 1A to 1C of the first embodiment.

An example of power saving control in this embodiment when the power saving mode is started manually or automatically will be explained below. FIG. 3 shows an example of transition control to the power saving mode in the display apparatus of this embodiment shown in FIGS. 1A to 1C. In this example, two power saving modes are set.

Note that this embodiment is not limited to specific control shown in FIG. 3, but control may be made to select and execute only an arbitrary power saving mode, or power saving mode control may be made at all possible timings. That is, an embodiment which has no power saving mode 2, or an embodiment which has no power saving mode 1 may be achieved, or an embodiment which has only power saving mode 1' may be achieved.

Figure 4:
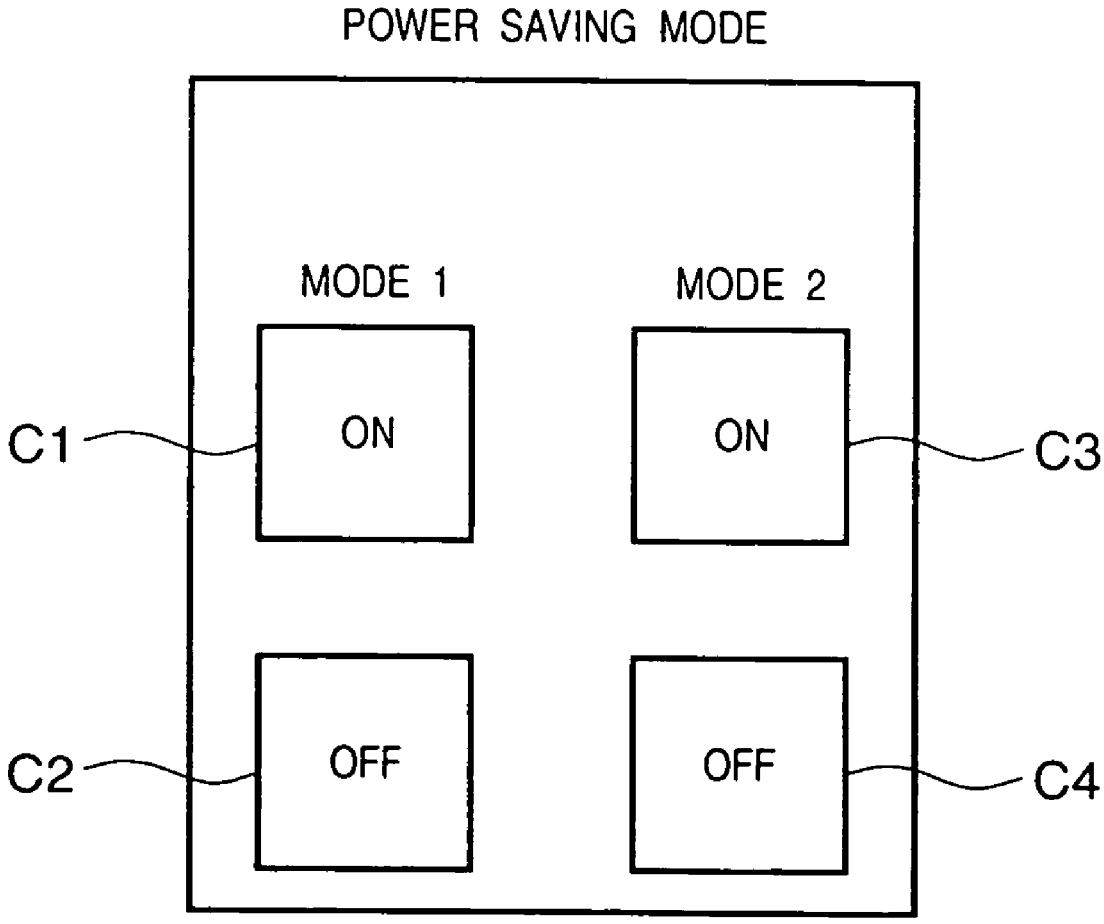
FIG. 4 is a view showing an example of the arrangement of a user switch shown in FIG. 1A in the first embodiment.

FIG. 4 shows an example of the arrangement of operation switches of the user switch means P18 shown in FIG. 1A, which is used to manually start the power saving mode. For example, these switches are equipped on a remote controller or the front panel of the image display apparatus.

In the example shown in FIG. 4, power saving modes 1 and 2 can be designated. A push-button switch C1 designates to turn on a switch (SW1) of power saving mode 1, a push-button switch C2 to turn it off, a push-button switch C3 to turn on a switch (SW2) of power saving mode 2, and a push-button switch C4 to turn it off.

A transition example of the power saving modes of this embodiment will be explained below with reference to the power saving mode transition chart shown in FIG. 3.

In FIG. 3, B1 indicates a normal state which is not a power saving mode but a normal mode, B2, a power saving mode 1 state; B3, a power saving mode 1' state; and B4, a power saving mode 2 state.

Power saving modes 1 and 1' suffer less deterioration of image quality, and executes the following power saving control (details will be explained later):

(a) a power saving mode by means of drive current amount control by changing If data;

(b) a power saving mode by changing PWM clocks;

(c) a power saving mode by changing ABL setups;

(d) a power saving mode by means of ABL by weighting the position of the display panel; and (e) a power saving mode by means of drive voltage control (including a case of the second embodiment to be, described later).

On the other hand, power saving mode 2 suffers some deterioration of image quality, and executes, e.g., the following power saving control:

(a) a power saving mode by multiplying luminance control data;

(b) a power saving mode by means of, e.g., image bit shift by computing image data; and (c) a power saving mode by reducing the frame size (the second embodiment to be described later).

(1) Transition Between Normal Mode (B1) and Power Saving Mode 1 (B2)

(a) Transition from the normal mode (B1) to power saving mode 1 (B2) takes place when the ON button C1 of the switch (SW1) of power saving mode 1 is pressed (BS01), and so forth.

(b) Transition from power saving mode 1 (B2) to the normal mode (B1) takes place when the OFF button C2 of the switch (SW1) of power saving mode 1 is pressed (BS02), and so forth.

(2) Transition Between Normal Mode (B1) and Power Saving Mode 2 (B4)

(a) Transition from the normal mode (B1) to power saving mode 2 (B4) takes place when the ON button C3 of the switch (SW2) of power saving mode 2 is pressed (BS03), when no input signal is detected (BS05), and so forth.

(b) Transition from power saving mode 2 (B4) to the normal mode (B1) takes place when the OFF button C4 of the switch (SW2) of power saving mode 2 is pressed (BS04), when a new input signal is detected after it has been absent and the input signal is white noise for a predetermined period of time, as described above (BS06), and so forth.

(3) Transition Between Power Saving Mode 1 (B2) and Power Saving Mode 2 (B4)

(a) Transition from power saving mode 1 (B2) to power saving mode 2 (B4) takes place when the ON button C3 of the switch (SW2) of power saving mode 2 is pressed (BS07), and so forth.

(4) Transition Between Power Saving mode 1' (B3) and Power Saving mode 1 (B2)

(a) Transition from power saving mode 1' (B3) to power saving mode 1 (B2) takes place when the ON button C1 of the switch (SW1) of power saving mode 1 is pressed (BS08), and so forth.

(5) Transition Between Power Saving Mode 1' (B3) and Power Saving Mode 2 (B4)

(a) Transition from power saving mode 1' (B3) to power saving mode 2 (B4) takes place when the ON button C3 of the switch (SW2) of power saving mode 2 is pressed (BS09), and so forth.

(6) Transition Between Normal Mode (B1) and Power Saving Mode 1' (B3)

(a) Transition from the normal mode (B1) to power saving mode 1' (B3) takes place in the following cases and the like:

- when the display time exceeds a predetermined period (BS10);
- when external illuminance is equal to or lower than a predetermined value (BS11); and
- when an input signal is a special one (e.g., a movie signal; MPEG 24P) (BS12).

(b) Transition from power saving mode 1' (B3) to the normal mode (B1) takes places in the following cases and the like:

- when the display time exceeds a predetermined period, and the OFF button C2 of the switch (SW1) of power saving mode 1 is pressed (BS13);
- when power saving mode 1' is set while external illuminance is equal to or lower than a predetermined value, and external illuminance exceeds the predetermined value (BS14); and
- when an input signal is a normal one (e.g., not a movie signal) (BS15).

Examples of the aforementioned power saving control will be described in detail below.

(1) Power Saving by Output Voltage Control of High-Voltage Power Supply P30

In this embodiment, the output voltage of the high-voltage power supply P30 can be controlled by the D/A unit P14 as one of the control inputs/outputs of the system controller including the MPU P11 as a main unit. Hence, by controlling the D/A unit P14, brightness control or power saving control of the display panel P2000 can be implemented.

(2) Power Saving by Element Drive Current Control Using if Setup Data

When the data selector means P1201 is set based on a switching signal from the I/O controller P13 to output If setup data output from the I/O controller P13 as one of the control inputs/outputs of the system controller including the MPU P11 as a main unit to the shift register P1107, the element drive currents can be controlled by the If setup data.

That is, the brightness of the display panel P2000 or consumption power of the display apparatus which includes this display panel P2000 can be controlled by varying the If setup data.

(3) Power Saving by Brightness Control of Display Panel by Varying PWM Clocks

Furthermore, this embodiment can vary the frequency of PWM clocks (not shown), which are generated by the X/Y-driver timing generator P1001 and used in the PWM generators P1102, in accordance with the output from the I/O controller P13 as one of the control inputs/outputs of the system controller including the MPU P11 as a main unit.

For example, when PWM clocks having a frequency twice that in the normal mode are used in pulse-width modulation by this switching control, the PWM generators P1102 generate output pulses each having a time duration obtained by counting pulses, the number of which is equal to the magnitude of luminance data, thus reducing the output pulse width to ½. That is, the element drive time is halved and, hence, luminance is halved.

By varying the PWM clocks in this manner, the brightness of the display panel or consumption power of the display apparatus which includes this display panel can be controlled.

(4) Power Saving by Brightness Control of Display Panel Using Output Luminance Control Data of I/O Controller P13

Each inverse γ table P7 shown in FIG. 1B may comprise a multiplier before tone characteristic conversion by means of the table. With such arrangement that comprises the multiplier before tone characteristic conversion by means of the table, luminance data from the A/D unit P6 and luminance control data output from the I/O controller P13 as one of the control inputs/outputs of the system controller including the MPU P11 as a main unit can be multiplied, thus varying the magnitude of luminance data using the luminance control data output from the I/O controller P13.

That is, the brightness of the display panel or consumption power of the display apparatus which includes this display panel can be controlled using the luminance control data output from the I/O controller P13.

The luminance data may be multiplied not by the digital unit but by the analog processor P3. The magnitude of luminance data can be controlled by varying the analog signal level input to each A/D unit P6 by R, G, or B gain adjustment signal from the D/A unit P14 as the output from the system controller as in multiplication in the digital unit.

(5) Power Saving by Brightness Control of Display Panel Using Display Switching Signal Output from I/O Controller P13

Each data selector P9 shown in FIG. 1B can comprise a function of an input digital signal by reducing its number of bits.

In this embodiment, the display switching signal output from the I/O controller P13 as one of the control inputs/outputs of the system controller including the MPU P11 as a main unit is assigned to be able to be used as a control signal for reducing the number of bits. For example, an input 8-bit signal is bit-shifted by one or two bits to be converted into a 7- or 6-bit signal to omit a bit or bits on the LSB side, and the converted signal is output. With this operation, a luminance signal can be approximately reduced to ½ to ¼.

That is, the brightness of the display panel or consumption power of the display apparatus which includes this display panel can be controlled using the display switching signal output from the I/O controller P13.

(6) Power Saving of Display Apparatus by Varying Operation Sensitivity of ABL

In the above description, ABL control can be done by detecting the average luminance levels per frame using the video detectors P4. By varying the operation sensitivity of ABL, consumption power of the display apparatus can be controlled.

In the display apparatus of this embodiment, the emission level of the panel is predicted from the average luminance level of the input signal, so that the average emission luminance level of all the elements that defines the screen assumes a value obtained by multiplying a peak luminance level by a coefficient equal to or smaller than 1, and the average emission luminance level of all the elements is suppressed by varying the element drive amount, the high application voltage, the magnitude of a luminance signal, or the like.

For example, when the coefficient is 0.5, if it is predicted based on the average luminance level per frame that the emission level is equal to or lower than ½ the peak level, an image is displayed without any modification; if it is predicted that the emission level is higher than ½ the peak level, the average emission luminance level of all the elements is suppressed by varying the element drive amount, the high application voltage, the magnitude of a luminance signal, or the like, so that the emission level can become ½ the peak level.

That is, by varying this coefficient (ABL reference voltage) as a reference for ABL control, consumption power of the display apparatus can be controlled.

(7) Power Saving of Display Apparatus by Setting Different Luminance Suppression Levels of Screen Central and Peripheral Portions Furthermore, ABL may have weights depending on position on the display panel. Since important information is highly likely to appear at the screen central portion, when the display luminance is suppressed by ABL, the central portion is displayed with highest possible brightness by setting different luminance suppression levels on the screen central and peripheral portions, in place of setting the entire screen to be dark.

For example, the brightness of the screen central portion may be controlled to 50% the normal one, a portion slightly outside the central portion to 40%, the vicinities of the screen peripheral portion around that portion to 30%, and the four corner portions of the screen to 20%.

Such control for setting different luminance suppression levels on the screen central and peripheral portions can be implemented using the If table ROM P1202. Since the If table ROM P1202 can have If data in units of elements, a plurality of types of setup data with different If set values for the elements of the central portion and those of the peripheral portion are prepared, and the setup data are switched in accordance with the average luminance levels per frame detected by the video detector P4, thus realizing the power saving mode.

As described above, according to this embodiment, since the power saving mode (power saving modes 1 and 1') which suffers less deterioration of image quality, and the power saving mode (power saving mode 2) which suffers some deterioration of image quality are provided, the power saving mode which suffers less deterioration of image quality can be set when the mode is automatically switched, and the user can manually set either of these modes.

Second Embodiment

In the first embodiment described above, the power saving control that controls the display apparatus using the display panel (SED panel) by current-driven PWM has been exemplified. However, the present invention is not limited to such specific embodiment. For example, a display apparatus which similarly has power saving modes even when it is controlled by voltage-driven (switching (SW)-driven) PWM can be provided. An example of a display apparatus according to the second embodiment of the present invention, which uses a voltage-driven (SW-driven) display panel (SED panel) having power saving modes will be explained below.

Figure 5B:
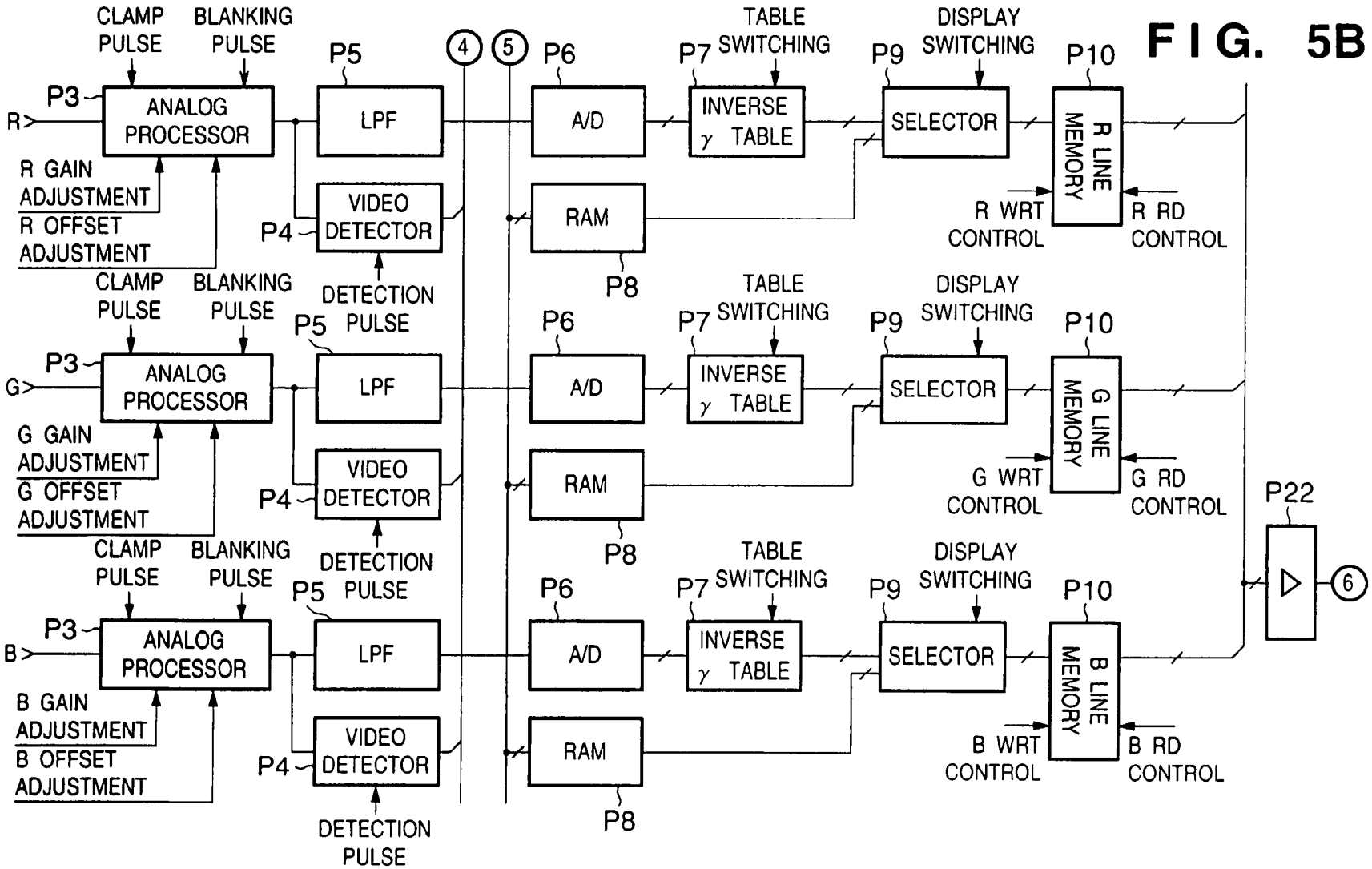
Figure 5C:
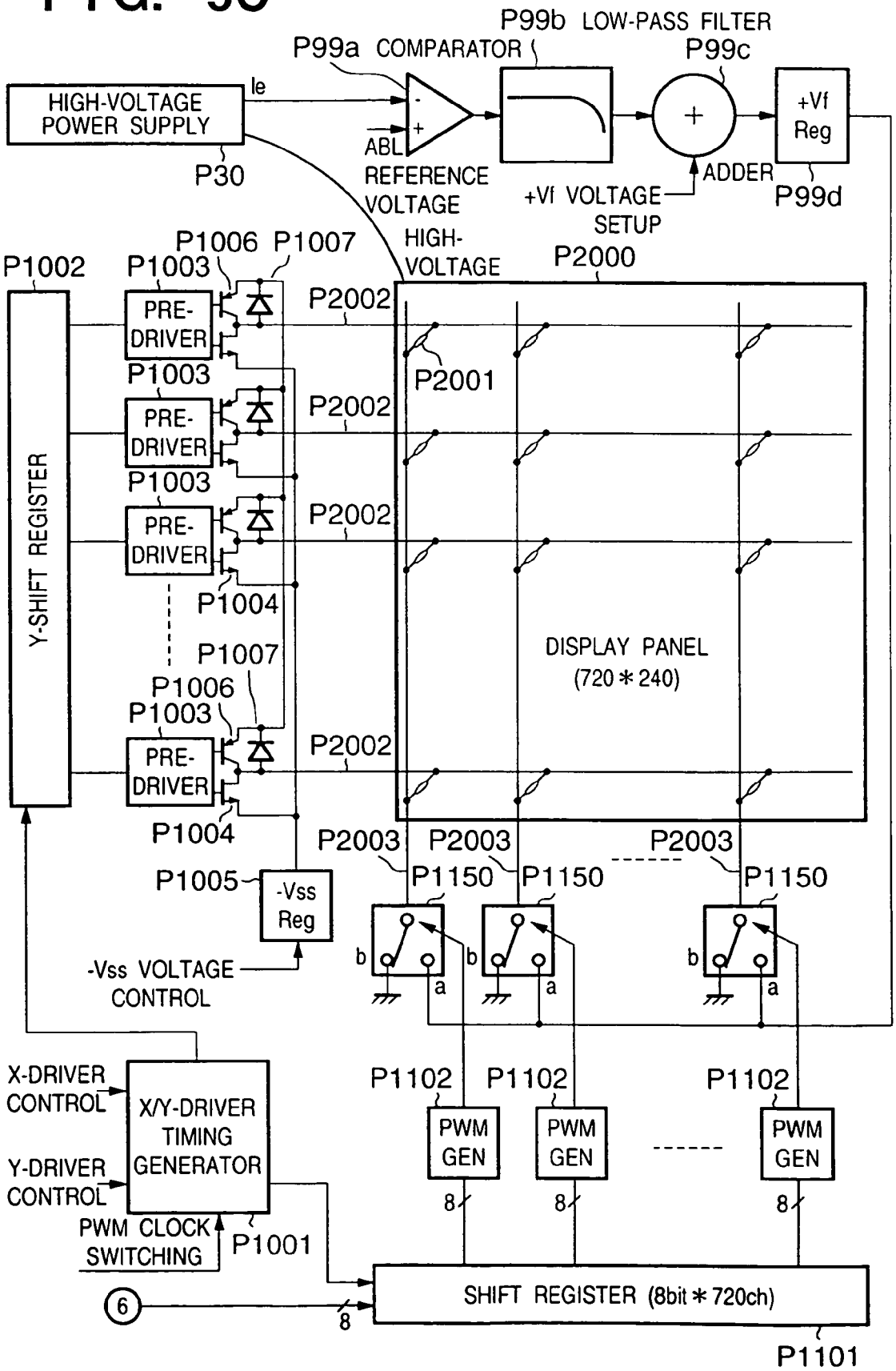
Figure 6:
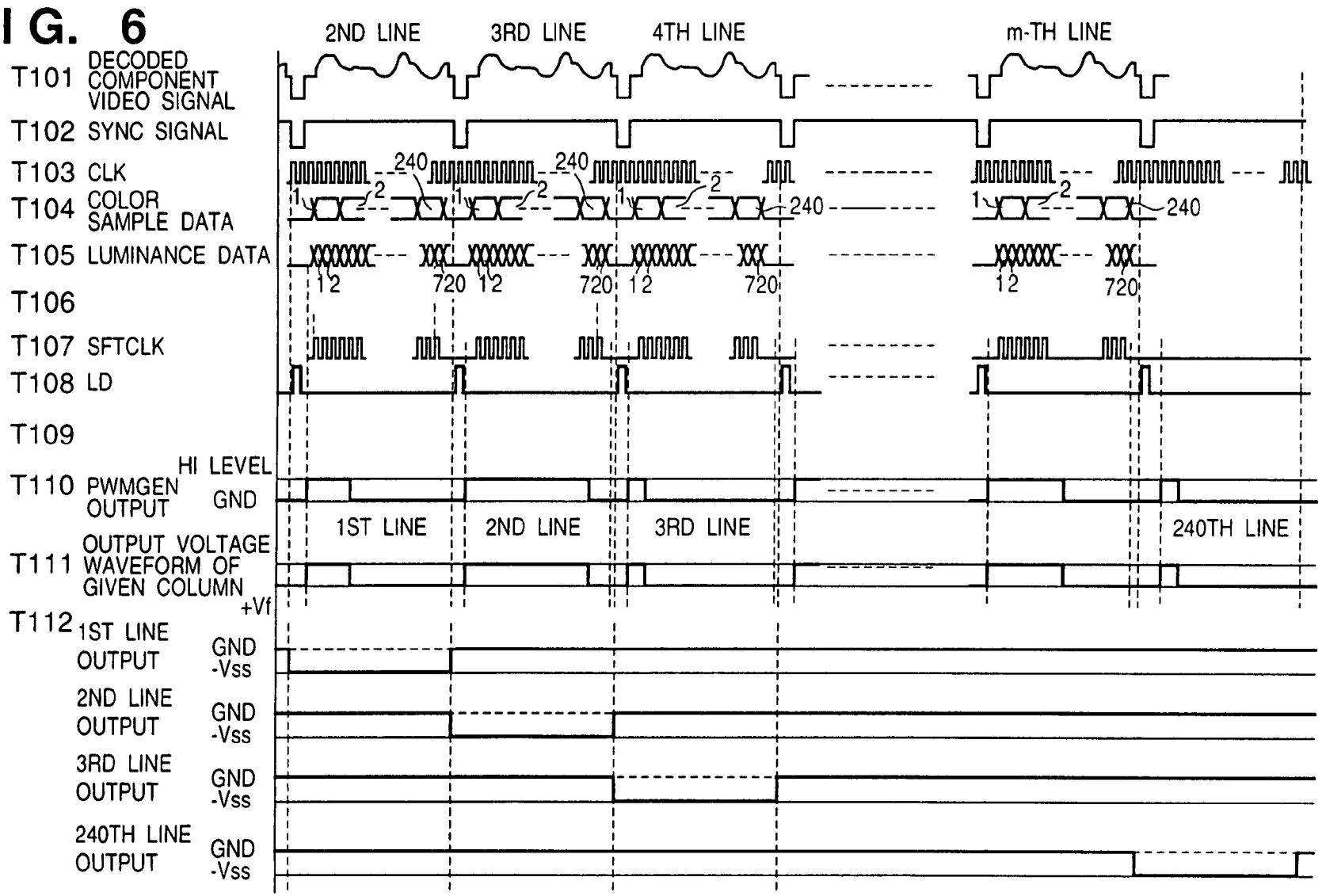
FIG. 6 is a timing chart showing the operation of the second embodiment shown in FIGS. 5A to 5C.

FIGS. 5A to 5C are block diagrams of a drive circuit of an SED panel according to the second embodiment of the present invention. FIG. 6 is a timing chart showing the operation of the second embodiment shown in FIGS. 5A to 5C. The same reference numerals in the second embodiment denote the same parts as those in the first embodiment shown in FIGS. 1A to 1C and FIGS. 2 to 4, and a detailed description thereof will be omitted.

Referring to FIGS. 5A to 5C, reference numerals A1*a* and A1*b* denote select switches, which switch between video inputs 1 and 2 in accordance with an input switching signal from the I/O controller P13. Reference numeral A2 denotes an NTSC-RGB decoder, which has the same arrangement as that of the NTSC-RGB decoder P1 shown in FIG. 1A.

Reference numeral A3 denotes a resolution converter which, for example, reduces decoded R, G, and B video signals as outputs from the NTSC-RGB decoder A2 to ¼ in the vertical and horizontal directions, and outputs the reduced video signals (in the arrangement of the resolution converter A3, for example, an input signal is converted into digital data by an A/D converter, one data is sampled every fourth data in the horizontal direction and is written in a memory, and one-line data is sampled every fourth-line data in the vertical direction and is written in the memory to consequently reduce an image to ¼ in the vertical and horizontal directions and write the reduced image in the memory; the data stored in the memory is read out at a video rate of a superimpose unit (to be described later) and is converted into an analog signal to be output by a D/A converter).

Reference numeral A4 denotes a superimpose unit for superimposing an image of input B onto that of input A by a switch means.

Reference numeral P1150 denotes switch means comprising field effect transistors and the like. Each switch means P1150 switches a contact from b to a to select the duration of a pulse width designated by the output from the corresponding PWM generator P1102, thus driving a corresponding column interconnect P2003 with the pulse width corresponding to image data.

Reference numeral P99*a* denotes a comparator which compares an ABL reference voltage as the output from the D/A unit P14 and a voltage proportional to an emitted electron beam current (Ie) from each surface conduction element P2001, and outputs a comparison result. Note that the gain of the comparator P99*a* is normally set to be relatively low so as to prevent hunting.

Reference numeral P99*b* denotes a filter circuit, which has a low-pass filter arrangement, and passes only signal components of a given frequency or less of the output from the comparator P99*a* to prevent hunting resulting from ABL. The order of the comparator P99*a* and filter circuit P99*b* is not limited to the illustrated example, but they may be inserted in the reversed order.

Reference numeral P99*c* denotes an adder which adds the output from the filter circuit P99*b* and a +Vf setup value as the output from the D/A unit P14 (the output from the comparator P99*a* is added in a direction to increase Ie and to decrease Vf). Reference numeral P99*d* denotes a +Vf regulator which outputs a column interconnect drive voltage in accordance with the output from the adder.

(Description of Power Saving Function)

The power saving functions of the second embodiment with the aforementioned arrangement will be explained below.

(1) Power Saving Based on Power Saving Control by Drive Voltage Control

In the arrangement of the second embodiment shown in FIGS. 5A to 5C, the drive voltage of each modulation interconnect P2003 is controlled in the power saving mode by the D/A unit P14 as one of the control inputs/outputs of the system controller including the MPU P11 as a main unit as follows.

(a) Drive Voltage Control of Row Interconnect (Scan Interconnect)

The drive voltage of each surface conduction element P2001 is lowered by setting |Vss| to a low voltage value for −Vss voltage control of the D/A unit P14 as one of the control outputs of the system controller so as to decrease the drive voltage of a corresponding row interconnect (scan interconnect) P2002, and consequently, the drive power and emission electron beam current (Ie) of each surface conduction element P2001 are decreased, thus suppressing consumption power.

(b) Drive Voltage Control of Column Interconnect (Modulation Interconnect)

The drive voltage of each surface conduction element P2001 is lowered by setting a low +Vf voltage setup value of the D/A unit P14 as one of the control outputs of the system controller so as to decrease the drive voltage of a corresponding column interconnect (modulation interconnect) P2003, and consequently, the drive power and emission electron beam current (Ie) of each surface conduction element P2001 are decreased, thus suppressing consumption power.

(2) Power Saving Based on Power Saving Control by Reducing Screen Size

As described above, in the arrangement of the second embodiment shown in FIGS. 5A to 5C, power savings can be achieved by controlling the total number of surface conduction elements P2001 to be driven. Note that this control can also be applied to power savings in the first embodiment described above.

(a) Control in Normal Mode

The following operations are made based on the output from the I/O controller P13 as one of the control outputs from the system controller.

The input select switch A1*a* selects contact a, video input 1 is decoded to R, G, and B signals by the NTSC-RGB decoder P1, and the decoded R, G, and B signals are output as an image on a main screen via the superimpose unit A4. The subsequent processes are the same as those in the first embodiment described above.

On the other hand, when an image is to be displayed on a sub-screen, the input select switch A1*b* is controlled to input a signal on the side of contact a. As a result, a signal of video input 2 is input to the NTSC-RGB decoder A2, and is decoded into R, G, and B signals. The decoded R, G, and B signals are reduced to ¼ in both the horizontal and vertical directions by the resolution converter A3. The reduced signals to be output are superimposed on the main screen as an image on the sub-screen via the superimpose unit A4. Of course, when no sub-screen is displayed, the superimpose unit A4 directly outputs the output from the NTSC-RGB decoder P1.

(b) Control in Power Saving Mode

In contrast to the aforementioned control in the normal mode, the following operations are made based on the output from the I/O controller P13 as one of the control outputs from the system controller in the power saving mode.

The input select switch A1*a* selects a signal on the side of contact b, and sends it to the NTSC-RGB decoder P1. In the second embodiment, the NTSC-RGB decoder P1 is controlled to output black in the power saving mode. As a result, a solid black image is output onto the main screen via the superimpose unit A4 (the panel is not driven). The subsequent processes are the same as those in the first embodiment described above.

On the other hand, the input select switch A1*b* selects contact b, and a signal of video input 1 is decoded into R, G, and B signals by the NTSC-RGB decoder A2. The decoded R, G, and B signals are reduced to ¼ in both the horizontal and vertical directions by the resolution converter A3. The reduced signals to be output are superimposed on the main screen as a sub-screen image via the superimpose unit A4.

That is, in the second embodiment, a video signal is generated so that an image to be displayed on the main screen is reduced to ¼ in the vertical and horizontal directions, and other portions are not driven.

As a result, the ratio of area to be driven is reduced to 1/16 (the number of elements to be driven is reduced to 1/16).

With this control, the drive power and emission electron beam current (Ie) of the surface conduction elements P2001 can be reduced to around 1/16, thus suppressing consumption power.

(3) Power Saving Based on ABL Operation Control

The ABL operation in the second embodiment will be described below. The following explanation will be given under the assumption that the output current of the high-voltage power supply P30 can be monitored. However, the present invention is not limited to such specific example, and this function need not be provided.

(a) Description of ABL Operation in Normal Mode

1) When the display panel is driven, the emission electron beam current (Ie) flows.

2) A voltage corresponding to Ie is output from the high-voltage power supply P30.

3) The comparator P99*a* compares the voltage corresponding to Ie with a coefficient serving as a reference for ABL control of the D/A unit P14 as one of the control outputs from the system controller (to be referred to as an "ABL reference voltage" hereinafter), and generates a negative output if the voltage corresponding to Ie is higher than the ABL reference voltage.

4) The filter circuit P99*b* performs low-pass filtering to pass only low-frequency components of the output from the comparator P99*a* to prevent hunting resulting from ABL.

5) The adder P99*c* adds the output from the filter circuit P99*b* and a +Vf voltage setup value from the D/A unit P14 as one of the control outputs from the system controller (that is, when Ie increases, an Ie increment is subtracted from the +Vf voltage setup value).

6) The +Vf regulator P99*d* generates a drive voltage of the modulation interconnects in accordance with the output from the adder P99*c*.

With the aforementioned procedures, the emission electron beam current (Ie) can be limited to the one corresponding to the coefficient serving as a reference for ABL control (ABL reference voltage).

(b) Description of ABL Operation in Power Saving Mode Setups of ABL Reference Voltage in Power Saving Mode 1) Power Saving by Drive Voltage Control When the drive current of each surface conduction element P2001 is set to be, e.g., ⅕ by the drive voltage control, a setup voltage in the power saving mode is set to be ⅕ the ABL reference voltage. In this manner, the average electric power can also be sufficiently reduced.

Also, the drive current of each surface conduction element P2001 is set to be, e.g., ½ by the drive voltage control, and a setup voltage in the power saving mode is set to be ⅕ the ABL reference voltage in the normal mode. In this manner, the peak luminance can be reduced to ½, and average electric power can be reduced to ⅕, thus achieving power savings (average electric power reduction) with sufficiently high image quality.

2) Power Saving by Reducing Screen Size

In the second embodiment, the display screen size is reduced to ¼ in the horizontal and vertical directions upon display. In this manner, the display area is reduced to 1/16. As a result, the setup voltage in the power saving mode can be set to be 1/16 the ABL reference voltage in the normal mode.

In this manner, the peak luminance remains the same in the normal display mode and the average electric power can be reduced to 1/16 while maintaining ABL effects, thus achieving power savings (average electric power reduction) with sufficiently high image quality.

Furthermore, when the setup voltage in the power saving mode is set to be 1/32 the ABL reference voltage in the normal mode, the average electric power can be further reduced.

As described above, according to the second embodiment, excellent power saving control can be achieved as in the first embodiment described above. Note that power saving control for the same building components as those in the first embodiment is the same as that in the first embodiment, and this embodiment similarly has a power saving mode (power saving modes 1 and 1') which suffers less deterioration of image quality, and a power saving mode (power saving mode 2) which suffers some deterioration of image quality.

In the second embodiment, the power saving mode (power saving modes 1 and 1') which suffers less deterioration of image quality, and the power saving mode (power saving mode 2) which suffers some deterioration of image quality can be selected as in the first embodiment. That is, control may be made to select the power saving mode which suffers less deterioration of image quality when the power saving mode is automatically switched, or to allow the user to select either power saving mode when the power saving mode is set by the user.

Figure 7:
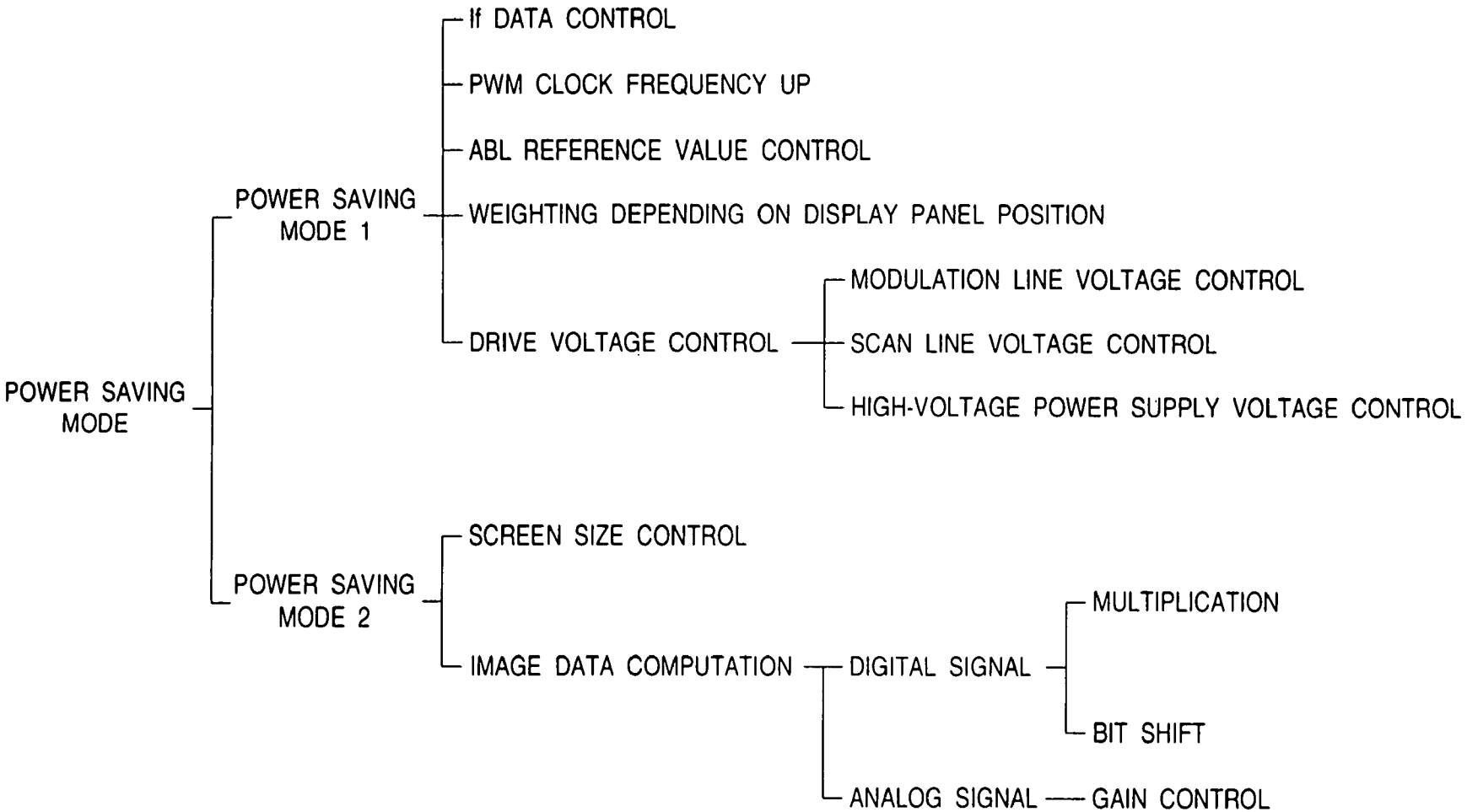
FIG. 7 shows a list of control targets of power saving mode control according to the first and second embodiments.

FIG. 7 shows a list of some power saving control targets of the first and second embodiments mentioned above. As shown in FIG. 7, power saving control can be done even in a flat-panel display apparatus by controlling respective parameters. The control can be made to select one of power saving mode 1, which suffers less deterioration of image quality, and power saving mode 2, which suffers some deterioration of image quality. When the power saving mode is automatically set, the control can select a power saving mode that displays an image similar to one displayed in a normal display mode and does not require the operator to select power saving mode 1, which suffers less image quality deterioration. When the power saving mode is set by a user's operation, the control can select either power saving mode. This power-saving control can be directly applied to a television broadcast display apparatus and the like, as well as to a display control of a computer terminal.

That is, the user can immediately recognize by watching the display screen whether or not television broadcast is being received, and can immediately recover the normal operation mode as needed.

Note that the aforementioned control can be made to select a mode that does not display any image like conventional power saving control on a display apparatus of a computer terminal, or to prevent an image quite different from the normal display mode from being displayed without requiring any operation of the operator, and can be directly applied to a television broadcast display apparatus and the like in addition to display control of a computer terminal.

Even in such case, the user can recognize the broadcast state and power saving mode control without any serious troubles, and can immediately recover the normal operation mode as needed.

To restate, according to the present invention, a flat-panel display apparatus with a power saving operation mode can be provided.

Also, according to the present invention, the control can be made to select one of a power saving mode that suffers less deterioration of image quality, and a power saving mode that suffers some deterioration of image quality. When the power saving mode is automatically set, a power saving mode that displays an image similar to an image displayed in a normal display mode can be implemented that does not require the operator to select the power saving mode that suffers less image quality deterioration. When the power saving mode is set by a user's operation, the user can select either power-saving mode. Such a power-saving control can be directly applied to a television broadcast display apparatus and the like, as well as to a display control of a computer terminal.

Even in such case, the user can recognize the broadcast state and power saving mode control without any serious troubles, and can immediately recover the normal operation mode as needed.

As many apparently widely different embodiments of the present invention can be made without departing from the spirit and scope thereof, it is to be understood that the invention is not limited to the specific embodiments thereof except as defined in the appended claims.

What is claimed is:

1. A display apparatus comprising:

a display panel including a plurality of display elements;

display control means for controlling said display panel in a normal display mode, a first power saving mode, a second power saving mode or a third power saving mode, wherein the first power saving mode is a mode in which said display panel displays an image; and mode transition means for causing said display panel to shift to the first power saving mode or the third power saving mode from a normal mode based on an instruction of a user, and causing said display panel to shift automatically to the second power saving mode from the normal mode, wherein the shift from the normal mode to the second power saving mode does not involve reduction of a frame size of an image displayed on the display panel, and the shift from the normal mode to the first or third power saving mode involves a reduction of the frame size.

2. The apparatus according to claim 1, wherein in the first power saving mode or the second power saving mode, a drive current of each of said display elements of said display panel is controlled.

3. The apparatus according to claim 1, wherein said display panel further includes a drive clock, and the first power saving mode or the second power saving mode can achieve power saving by changing a frequency of said drive clock of said display panel.

4. The apparatus according to claim 1, wherein in the first power saving mode or the second power saving mode, a drive voltage of said display panel is controlled.

5. The apparatus according to claim 1, wherein said display panel can display an image even in the second power saving mode or third saving mode, and the first power saving mode or the second power saving mode is a mode in which the electric power supplied to said display panel is decreased, and the third power saving mode is a mode in which the image data representing the image to be displayed is modified to save the electric power of said display panel.

6. The apparatus according to claim 1, wherein the second power saving mode is a mode in which said display panel displays an image.

7. The apparatus according to claim 1, wherein the second power saving mode or the third power saving mode is a mode in which said display panel displays an image.

8. A method of controlling a display apparatus, said method comprising:

a display control step of controlling a display panel in a normal display mode, a first power saving mode, a second power saving mode or a third power saving mode, wherein the first power saving mode is a mode in which the display panel displays an image; and a mode transition step of causing the display panel to shift to the first power saving mode or the third power saving mode from the normal mode based on an instruction of a user, and causing the display panel to shift automatically to the second power saving mode from the normal mode, wherein the shift from the normal mode to the second power saving mode does not involve reduction of a frame size of an image displayed on the display panel, and the shift from the normal mode to the first or third power saving mode involves a reduction of the frame size.

9. The method according to claim 8, wherein in the first power saving mode or the second power saving mode, a drive current of each display element of the display panel is controlled.

10. The method according to claim 8, wherein the first power saving mode or the second power saving mode can achieve power saving by changing a frequency of a drive clock of the display panel.

11. The method according to claim 8, wherein in the first power saving mode or the second power saving mode, a drive voltage of the display panel is controlled.

12. The method according to claim 8, wherein the display panel can display an image in the second power saving mode or third power saving mode, and the first power saving mode or the second power saving mode is a mode in which the electric power supplied to the display panel is decreased, and the third power saving mode is a mode in which image data representing the image to be displayed is modified to save the electric power of said display panel.

13. The method according to claim 8, wherein the second power saving mode is a mode in which the display panel displays an image.

14. The method according to claim 8, wherein the second power saving mode or the third power saving mode is a mode in which the display panel displays an image.

* * * * *

UNITED STATES PATENT AND TRADEMARK OFFICE

CERTIFICATE OF CORRECTION

PATENT NO. : 7,295,197 B2
APPLICATION NO. : 10/775168
DATED : November 13, 2007
INVENTOR(S) : Naoto Abe et al.

It is certified that error appears in the above-identified patent and that said Letters Patent is hereby corrected as shown below:

ON THE TITLE PAGE, ITEM [75] INVENTORS:

"Naoto Abe, Kanagawa-ken (JP); Tatsuro Yamazaki, Tokyo (JP)" should read --Naoto Abe, Yokohama (JP); Tatsuro Yamazaki, Machida (JP)--.

SHEET 1:

FIG. 1A, "PLUS" (all occurrences) should read --PULSE--.

SHEET 7:

FIG. 5A, "PLUS" (all occurrences) should read --PULSE--.

COLUMN 6:

Line 35, "by P108." should read --by T108.--.

COLUMN 17:

Line 40, "third" should read --third power--.

Signed and Sealed this

Third Day of February, 2009

John Doll

JOHN DOLL
*Acting Director of the United States Patent and Trademark Office*